US006326534B1

(12) United States Patent
Ishimatsu

(10) Patent No.: US 6,326,534 B1
(45) Date of Patent: Dec. 4, 2001

(54) SIMPLE STABLE STAND FOR MUSICAL INSTRUMENT

(75) Inventor: Norihiko Ishimatsu, Shizuoka (JP)

(73) Assignee: Yamaha Corporation, Tokyo (JP)

( * ) Notice: Subject to any disclaimer, the term of this patent is extended or adjusted under 35 U.S.C. 154(b) by 0 days.

(21) Appl. No.: 09/670,928

(22) Filed: Sep. 28, 2000

(30) Foreign Application Priority Data

Sep. 30, 1999 (JP) ..... 11-279647

(51) Int. Cl.[7] ..... G10D 13/02
(52) U.S. Cl. ..... 84/422.3; 81/422.1; 81/422.2
(58) Field of Search ..... 84/421, 422.1, 84/422.2, 422.3

(56) References Cited

U.S. PATENT DOCUMENTS

| | | | | |
|---|---|---|---|---|
| 3,464,305 | | 9/1969 | Meazzi et al. . | |
| 3,988,957 | * | 11/1976 | Escamilla | 84/422 R |
| 4,111,095 | * | 9/1978 | Simons | 84/422 R |
| 4,381,690 | * | 5/1983 | Kimble | 84/422 R |
| 4,488,471 | * | 12/1984 | Youakim | 84/422 R |
| 5,105,706 | | 4/1992 | Lombardi | 84/422.3 |
| 5,565,637 | * | 10/1996 | Shigenaga | 84/422.1 |
| 5,574,237 | * | 11/1996 | Yanagisawa | 84/422.1 |
| 5,945,616 | * | 8/1999 | Hoshino | 84/422.3 |

FOREIGN PATENT DOCUMENTS

| | | |
|---|---|---|
| 2322223 | 8/1998 | (GB) . |
| 10-232670 | 9/1998 | (JP) . |

OTHER PUBLICATIONS

European Search Report issued Jan. 22, 2001 in a related application.

Patent Abstracts of Japan, vol. 1999, No. 13, Nov. 30, 1999 & JP 11–219169 A (Hoshino Gakki KK) Aug. 10, 1999, *abstract; figure 2*.

* cited by examiner

*Primary Examiner*—Robert E. Nappi
*Assistant Examiner*—Kim Lockett
(74) *Attorney, Agent, or Firm*—Ostrolenk, Faber, Gerb & Soffen, LLP

(57) ABSTRACT

A high-hat stand has a telescopic guide tube supported by a pedestal, a pedal mechanism connected to a movable rod inserted in the telescopic guide tube and a generally U-letter shaped connector for connection, a heel of the pedal mechanism to the pedestal, wherein the generally U-letter shaped connector has a certain modulus of section so as to keep the clasticity thereof against a maximum bending moment exerted thereon during a performance so that the high-hat stand is simple in structure without sacrifice of the stability.

16 Claims, 5 Drawing Sheets

SIMPLE STABLE STAND FOR MUSICAL INSTRUMENT

FIELD OF THE INVENTION

This invention relates to a stand for a musical instrument and, more particularly, to a stand for a percussion instrument such as, for example, high-hat cymbals.

DESCRIPTION OF THE RELATED ART

The high-hat cymbals form a drum set together with a bass drum, a snare drum, a set of tom toms, a floor tom and a side cymbal. Only one drummer sits on a chair among the percussion instruments, and performs music through those percussion instruments. Accordingly, the percussion instruments are to be arranged on a floor within the reach of drummer's hands. Although the drummer strikes the snare drum, the tom toms, the floor tom and the side cymbal with sticks, the bass drum and the high-hat cymbals are usually actuated by the drummer's foot. Foot pedals are placed on the floor near the chair, and are linked with a bass drum beater and a rod, respectively. The rod is connected to the upper high-hat cymbal, and the upper high-hat cymbal is opposed to the lower high-hat cymbal. When the drummer steps on the pedals, the bass drum beater strikes the skin of the bass drum, and the rod clashes the upper high-hat cymbal against the lower high-hat cymbal. The space within the reach of drummer's hands is so narrow that the drummer is to arrange the percussion instruments closely. For this reason, the percussion instrument is expected to occupy the floor as narrow as possible.

FIGS. 1 and 2 show a typical example of the stand for the high-hat cymbals. The stand for the high-hat cymbals is hereinbelow referred to as "high-hat stand". The prior art high-hat stand is put on a floor FL, and keeps the high-hat cymbals 1 spaced therefrom. One of the high-hat cymbals 1 is stationary, and is labeled with reference 1A. The other of the high-hat cymbals 1 is movable, and is labeled with 1B. The movable cymbal 1B is spaced from the stationary cymbal 1A, and is clashed against the stationary cymbal 1A for generating indefinite pitched sound.

The prior art high hat stand comprises a telescopic guide 2, an extension rod 9, a pedal mechanism 3 and a foldable tripod 4. A spring unit 6, plural pipes 7/ 8, a suitable coupling and a thumbscrew constitute the telescopic guide 2, and the extension rod 9 is slidable inside the telescopic guide 2. The extension rod 9 is inserted into the telescopic guide 2, and projects from the upper end of the pipe 8 and the lower end of the spring unit 6. The stationary cymbal 1A is fixed to the upper end of the pipe 8, and the movable cymbal 1B is fixed to the extension rod 9. The pedal mechanism 3 is connected to the lower end of the extension rod 9.

As will be seen in FIG. 2, the spring unit 6 includes a cylindrical case 6*a*, a return spring 10 and a retainer ring 6*c*. The cylindrical case 6*a* is fixed to the lower end of the pipe 7, and the retainer ring 6*c* is fixed to the extension rod 9. The return spring 10 is accommodated in the cylindrical case 6*a*, and is connected at one end thereof to the retainer ring 6*c* and at the other end thereof to the bottom portion of the cylindrical case 6*a*. Thus, the return spring 10 upwardly urges the extension rod 9 at all times. This results in that the movable cymbal 1B is spaced from the stationary cymbal 1A under the condition that no force is exerted on the pedal mechanism 3. When the extension rod 9 is pulled into the telescopic guide 2, the movable cymbal 1B is clashed against the stationary cymbal 1A.

The coupling is attached to the pipe 7, and prohibits the pipe 8 from coming out of the other pipe 7. The pipe 8 is extendable from and retractable into the pipe 7, and the thumbscrew fixes the relative position between the pipes 7 and 8.

The foldable tripod 4 includes three legs 16*a*/ 16*b*/ 16*c*, retainer rings 17/19 and three foldable stays 18*a*/ 18*b*/ 18*c*. The three legs 16*a*/ 16*b*/ 16*c* are connected at upper ends thereof to the retainer ring 17, and the retainer ring 17 is fixed to the pipe 7. The other retainer rint, 19 is fixed to the cylindrical case 6*a*, and is closer to the floor FL than the retainer ring 17. The three legs 16*a*/ 16*b*/ 16*c* are angularly spaced at 120 degrees from one another. The foldable stays 18*a*/ 18*b*/ 18*c* are connected at the inner ends thereof to the retainer ring 19 and at the outer ends thereof to the legs 16*a*/ 16*b*/ 16*c*. When the stays 18*a*/18*b*/18*c* are stretched, the legs 16*a*/16*b*/16*c* brace the telescopic guide 2 on the floor FL, and keeps the guide 2 and, accordingly, the high-hat cymbals 1 upright.

The pedal mechanism 3 includes a pedestal 11, a foot pedal 12, a heel 13, a connecting, rod 14 and a texible connector 15. The pedestal 11 has an L-letter shape, and is formed of light metal such as aluminum alloy. The pedestal 11 is broken down into a base plate 11A and a frame 11B. The base plate 11A is placed on the floor FL, and the cylindrical case 6*a* is fixed to the frame 11B. Thus, the pedestal 11 makes the floor FL receive the weight of the telescopic guide 2, and the foldable tripod 4 keeps the telescopic guide 2 upright on the floor FL.

The heel 13 is connected through the connecting rod 14 to the base plate 11A. The connecting rod 14 spaces the heel 13 from the base plate 11A by a predetermined distance. The connecting rod 14 is only expected to space the heel 13 from the base plate 11A, and the diameter is 6 millimeters. The foot board 12 is hinged at one end thereof to the heel 13 and at the other end thereof to the extension rod 9 through the flexible connector 15. The flexible connector 15 is, by way of example, formed of leather, and changes the rotation of the foot pedal 12 around the heel 13 to the straight motion of the extension rod 9.

When a drummer depresses the foot pedal toward the floor FL, the foot pedal 12 is driven for rotation, and the flexible connector 15 converts the rotation to the straight motion. Then, the extension rod 9 is pulled down against the elastic force of the return spring 10, and the movable cymbal 1B is clashed against the stationary cymbal 1A. When the drummer releases the foot pedal 12, the return spring 10 pulls up the extension rod 9, and spaces the movable cymbal 1B from the stationary cymbal 1A.

As described hercinbcltric, the narrower the occupation area, the closer the percussion instruments. If the legs 16*a*/ 16*b*/ 16*c* are long and widely spread, the high-hat sand occupies wide area, and other percussion instruments are sparsely arranged around the drummer. The drummer may find it hard to beat the farthest percussion instrument. On the other hand, if the legs 16*a*/ 16*b*/ 16*c* are short and narrowed, the high-hat stand is unstable, and feel the arrangement on the floor overcrowded. While a drummer is performing the drum set, the drummer is liable to hit his leg against the leg 16*a*/ 16*b*/ 16*c*, and bring down the high-hat stand.

Although the leg 16*a*/ 16*b*/ 16*c* of the prior art high-hat stand is evenly spaced from the other legs 16*b*/ 16*c*/16*a* at 120 degrees, another prior art high-hat stand has a trapezoid, the legs of which are unevenly spaced. The legs are assumed to be corresponding to the legs 16*a*/ 16*b*/ 16*c*. The leg 16*b* is located at the back of the foot pedal, and each of the other two legs 16*a*/ 16*c* is spaced from the leg 16*b* at 15 degrees. This means that the leg 16*a* is spaced from the leg 16*c* at 150 degrees. There is not any leg on both sides of the foot pedal, and the drummer is less liable to hit his foot against the legs. However, the arrangement of legs makes the prior art high-hat stand more unstable than the evenly arranged legs 16*a*/16*b*/16*c*. When drawing a perpendicular line from the contact spots of the leg corresponding to the leg 16*a*/16*c* to the extension line of the pedestal of the pedal mechanism, the perpendicular line is shorter than that of the legs 16*a*/16*c*, and the prior art high-hat stand is liable to fall down sideways. Moreover, when another perpendicular line is drawn from the pedestal to a virtual line extending between contact spots of the legs corresponding to the legs 16*a* and 16*c*, the perpendicular line is also shorter than the corresponding perpendicular line extending from the pedestal 11 to the virtual line between the contact spots of the legs 16*a* and 16*c*, and the prior art high hat stand is likely to fall down toward the drummer. Thus, there is a trade-off between the stability and the performability.

Yet another prior art high-hat stand is disclosed in Japanese Patent Publication of Unexamined Application No. 10-232670. The prior art high-hat stand has only two legs. The prior art high-hat stand has a supporting board projecting from the pedestal of the pedal mechanism toward the drummer. The contact spots of the two legs and the supporting board are located at the three vertexes of a virtual triangle on the floor, and set the telescopic guide upright. The Japanese Patent Publication of Unexamined Application teaches another supporting board projcctable from and retractable into the pedestal of the pedal mechanism. When a drummer draws out the slide board from the pedestal, the slide board and the contact spots of the two legs are located at the three vertexes of the virtual triangle on the floor, and also set the telescopic guide upright.

A problem is encountered in the prior at high- hat cymbals disclosed in the Japanese Patent Publication of Unexamined Application in the intricate structure. Although the prior art high-hat stand is fairly stable and creates a space around drummer's pedal, the manufacturer is to machine parts of the supporting board, and the parts arc assembled with the pedestal of the pedal mechanism. The supporting board makes the prior art high- hat stand intricate. This results in increase of the production cost. In case of the projectable supporting board, the prior art high- hat stand becomes more intrinsic, and the production cost is increased. Moreover, the drummer is required to fix the projectable supporting board to the pedestal with a suitable tool before setting the telescopic guide upright, and the drummer feels the setting work onerous.

Still another prior art high-hat stand is disclosed in U.S. Pat. No. 510,5706. The prior art high-hat stand also has two legs, and the heel is connected through a rigid connecting rod and a base plate to the pedestal. The contact spots of the two legs and the base plate arc located at the three vertexes of a virtual triangle, and set the telescopic guide upright. The prior art high-hat stand is also stable on a flat surface, and creates a space around drummer's foot. However, the prior art high-hat stand requires additional parts, and the drummer is to attach the base plate to the pedestal by using a tuning key or a wrench before setting the telescopic guide upright. The drummer feels the setting work and the disassembling work onerous. Moreover, the base plate has fairly wide bottom surface. If the high-hat stand is put on a rough surface such as a surface of land, the entire bottom surface of the base plate is not held in contact with the rough surface, and the prior art high-hat stand is liable to be fallen down during the performance. Finally, the base plate is an eyesore, and makes the prior art high-hat stand ill-shaped.

SUMMARY OF THE INVENTION

It is therefore an important object of the present invention to provide a stand for a musical instrument which is simple in structure, well-shaped and easy to use without sacrifice of the stability.

In accordance with one aspect of the present invention, there is provided a stand for a musical instrument comprising a driving mechanism connected to the musical instrument and actuated for generating sound, a pedal mechanism having a pedal plate connected to the driving mechanism and manipulated by a player for actuating the driving mechanism and a heel placed on a surface and providing an axis of rotation to the pedal plate, and a supporting structure connected to the driving mechanism and the pedal mechanism for setting the driving mechanism stably on the surface and including a pedestal placed on the surface and receiving the total weight of the driving mechanism and the musical instrument and a safety device against overturning connected between the pedestal and the heel and including a connector formed from a single bar having a certain modulus ot section so as to keep the elasticity thereof against a maximum bending moment exerted thereon during a performance, thereby preventing the musical instrument from a violent fall during the performance.

BRIEF DESCRIPTION OF THE DRAWINGS

The features and advantages of the stand for a musical instrument will be more clearly understood from the following description taken in conjunction with the accompanying drawings in which.

DESCRIPTION OF THE PREFERRED EMBODIMENTS

First Embodiment

Figure 3:
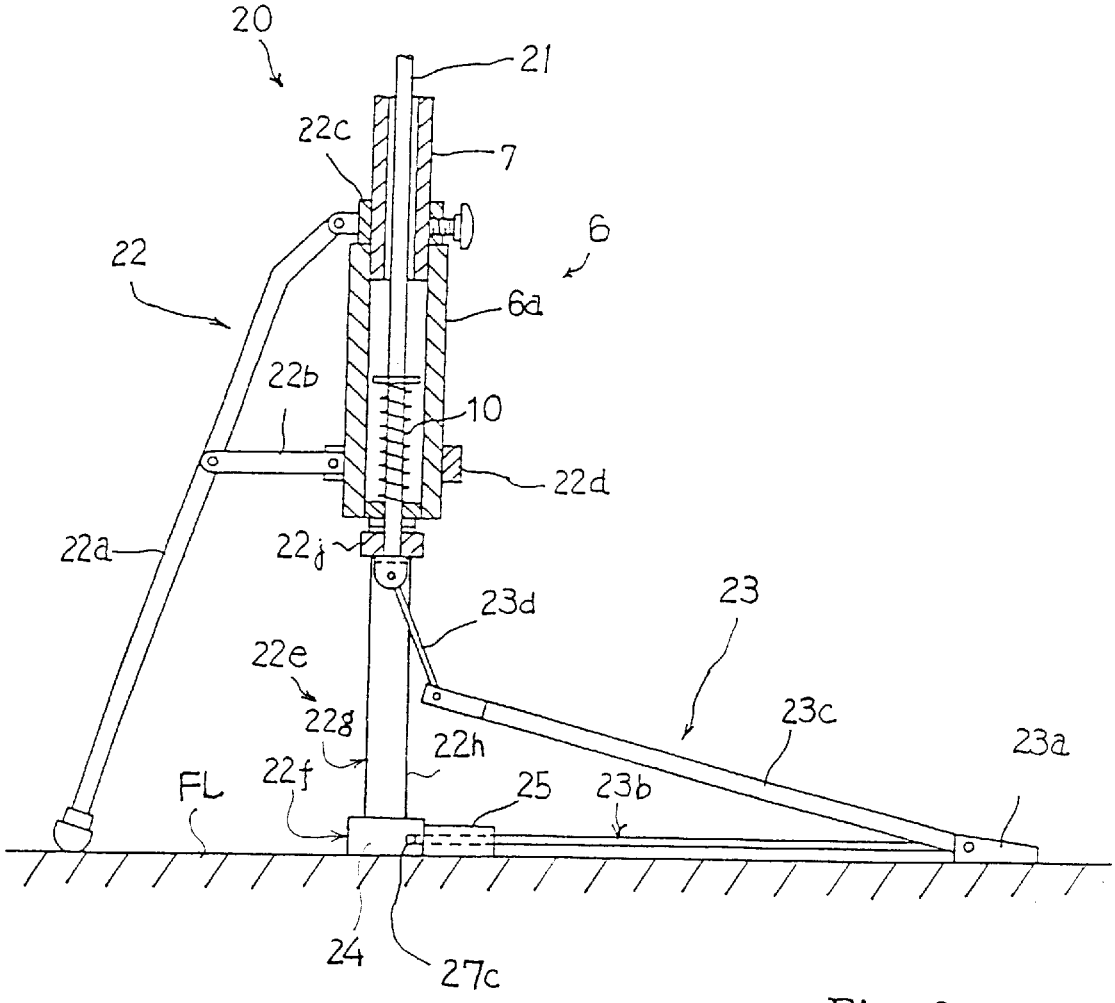
FIG. 3 is a cross sectional side view showing the structure of a high-hat stand according to the present invention.

Referring to FIG. 3 of the drawings, a high-hat stand embodying the present invention largely comprises a telescopic guide 20, an extension rod 21, a supporting structure 22 and a pedal mechanism 23. In the following description, words "front" and "rear" are representative of relative relation between two positions. The word "front" indicates a position closer to a drummer sitting on a chair for performing music, and word "rear" indicates a position farther from the drummer than the front position.

Figure 1:
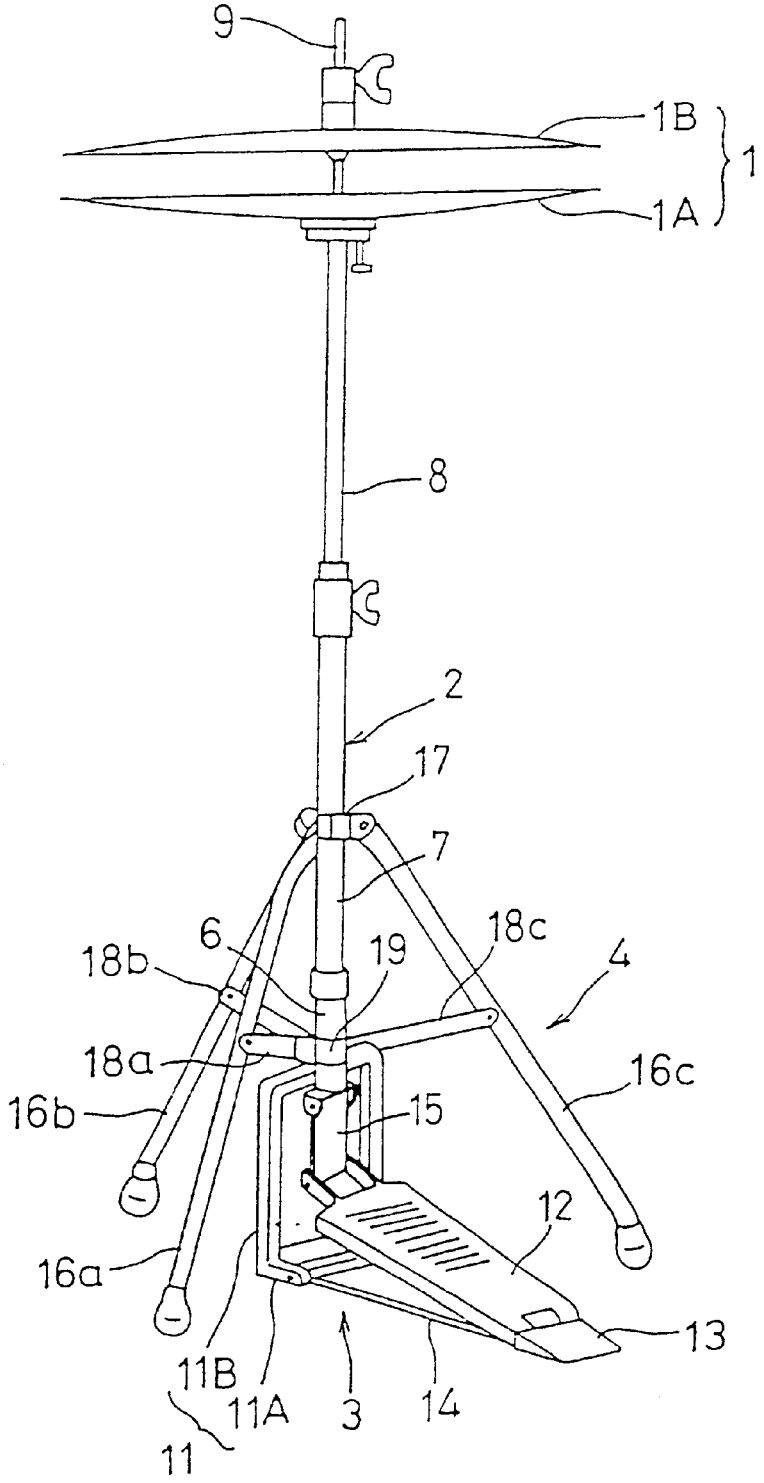
Fig. 1 PRIOR ART
FIG. 1 is a perspective view showing the high-hat cymbals on the prior art high-hat stand.
Figure 2:
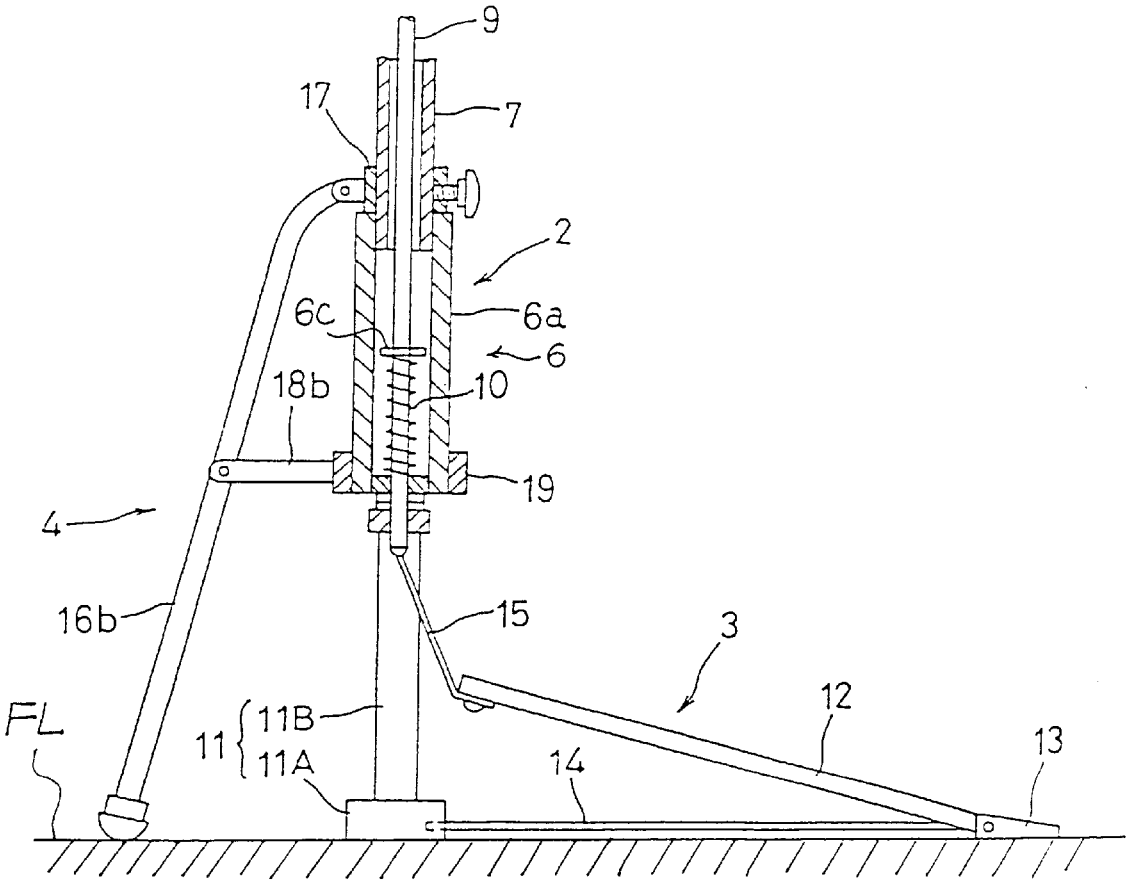
Fig. 2 PRIOR ART
FIG. 2 is a cross sectional view showing the structure of the prior art high-hat stand.

The telescopic guide 20 is similar in structure to the telescopic guide 2 incorporated in the prior art high-hat stand shown in FIG. 1, and the components of the telescopic guide 20 are labeled with the references designating corresponding components of the telescopic guide 2 without detailed description. The extension rod 21 is inserted into the inner space of the telescopic guide 20, and projects from opposite ends of the telescopic guide 20. Though not shown in FIG. 3, high-hat cymbals are connected to the upper end of the telescopic guide 20 and the upper end of the extension rod 21, and are opposed to each other in a similar manner to the high-hat cymbals 1.

The supporting structure 22 includes a pair of legs 22*a*, a pair of stays 22*b*, retainer rings 22*c*/ 22*d*, a pedestal 22*e*, a heel 23*a* and a connector 23*b*. The heel 23*a* and the connector 23*b* are shared between the supporting structure 22 and the pedal mechanism 23 as will be hereinbelow described in detail.

The pair of legs 22*a* are stretchable, and project downwardly from the telescopic guide 20. The telescopic guide 20 is put on the pedestal 22*e*, and is fixed thereto. The heel 23*a* is connected to the pedestal 22*e* by means of the connector 23*b*. The pedestal 22*c* and the heel 23*a* are placed on the floor FL. However, the connector 23*b* is spaced from the floor 23*b*. The pair of legs 22*a*, the pedestal 22*e* and the heel 23*a* are held in contact with the floor FL.

The retainer rings 22*c* and 22*d* are fixed to the pile 7 and the cylindrical case 6*a*, respectively. The legs 22*a* are hinged at the upper end thereof to the retainer ring 22*c*, and the stays 22*b* are hinged at the inner ends thereof to the other retainer ring 22*c*, and the stays 22*b* are hinged at the inner ends thereof to the other retainer ring 22*d*. Though not shown in FIG. 3, elongated holes are formed in intermediate portions of the legs 22*a*. Pins are respectively attached to the outer ends of the stays 22*b*, and are slidably received in the elongated holes. The stays 22*b* are turnable around the retainer ring 22*d*. When a drummer changes the stays 22*b* to a position close to the pedestal 22*e*, the legs 22*a* are pulled toward the telescopic guide 20, and the high-hat stand occupies a narrow space. Then, the high-hat stand is ready for storage. On the other hand, when the drummer stretches the legs 22*a*, the stays 22*b* rotate around the retainer ring 22*d* by 90 degrees, and keep the legs 22*a* spaced from the pedestal 22*e*. The contact spots between the legs 22*a* and the floor FL and the contact spot between the heel 23*a* and the floor occupy the three vertexes of a virtual triangle. Although the pedestal 22*e* supports most the weight of the telescopic guide 20, the extension rod 21 and the high-hat cymbals, the legs 22*a* and the heel 23*a* are stably set the telescopic guide 20 upright on the floor FL.

Figure 5:
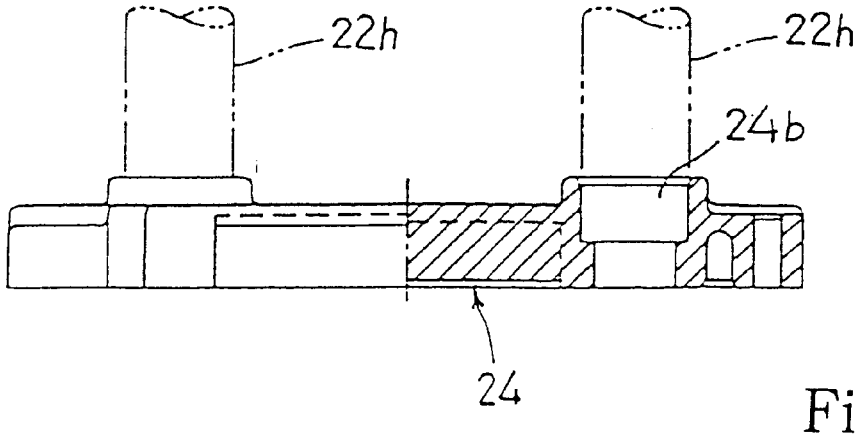
FIG. 5 is a cross sectional view taken along line III—III of FIG. 4 and showing the connection between a base plate and a frame.

The pedestal 22*e* includes a base plate 22*f* and a frame 22*g*. The frame 22*g* has two posts 22*h* (FIG. 5) and a lateral bar 22*j*. The two posts 22*h* are connected to opposite end portions of the lateral bar 22*j*. The telescopic guide 20 is fixed to the lateral bar 22*j*, and the posts 22*h* are embedded into the base plate 22*f*.

Figure 4:
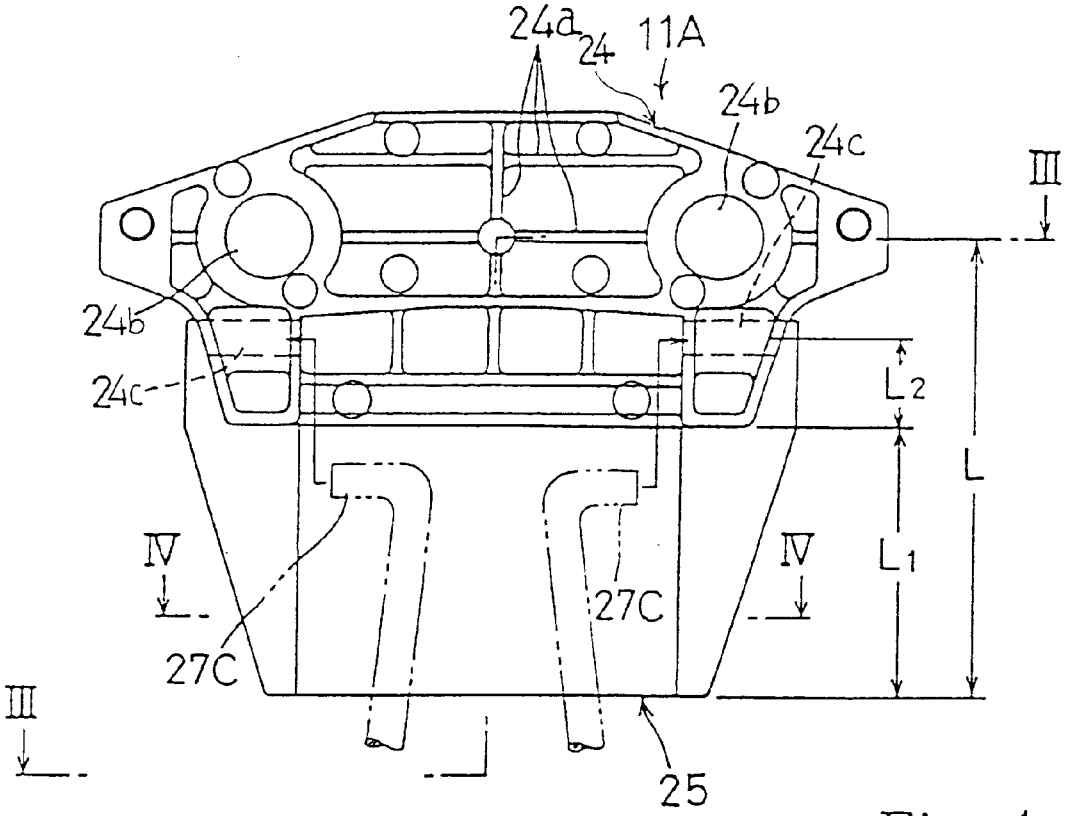
FIG. 4 is a bottom view showing the back surface of a pedestal incorporated in the high-hat stand.

The base plate 22*f* is broken down into a supporting block 24 and an extension block 25. The supporting block 24 and the extension block 25 are formed in a monolithic structure. The supporting block 24 has a leaf-like configuration, and ribs 24*a* (FIG. 4) reinforce the supporting block 24. A pair of vertical holes 24*b* and a pair of lateral holes 24*c* are formed in the supporting block 24. The vertical holes 24*b* are located in both side portions of the supporting block 24, and are open to the upper surface of the supporting block 24. The two posts 22*h* are snugly inserted into the vertical holes 24*b*. Thus, the supporting block 24 receives most of the total weight of the telescopic guide 20, the extension rod 21 and the high-hat cymbals.

Figure 6:
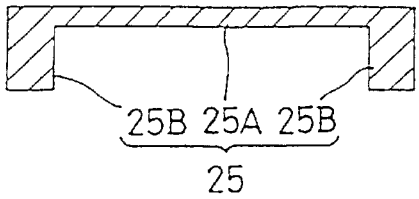
FIG. 6 is a cross sectional view taken along line IV—IV of FIG. 4 and showing the base plate.

A pair of lugs project frontwardly from the supporting block 24, and the lugs are spaced from one another so as to form a gap therebetween. The lateral holes 24*c* are formed in the lugs, respectively, and are open to the gap. The extension block 25 has an upper flat portion 25A and a pair of side walls 25B. The side walls 25B (FIG. 6) project downwardly from opposite side portions of the upper flat plate 25A, and form a gap therebetween. The rear portions of the side walls 25B are formed with recesses corresponding to the lugs, and the lugs are snugly received in the recesses, respectively. The gap between the lugs is overlapped with the gap between the side walls 25B, and the gap is open to the front surface of the extension block 25.

Figure 7:
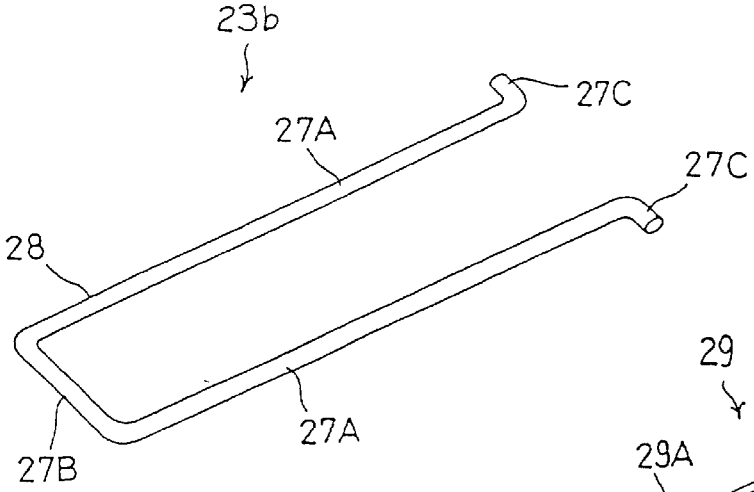
FIG. 7 is a perspective view showing a connector incorporated in the high-hat stand.

The connector 23*b* (FIG. 6) is formed from a round bar 28 of metal or alloy. The round bar 28 is bent four times, and the connector 23*b* has a U-letter shape as shown in FIG. 7. Thus, the connector 23*b* has a pair of longitudinal portions 27A, a lateral portion 27B and a pair of lugs 27C. The longitudinal portions 27A project rearwardly from opposite ends of the lateral portion 27B, and the lugs 27C sideward project from the rear ends of the longitudinal portions 27A. The lateral portion 27B is connected to the heel 23*a* by means of a bracket and bolts.

A drummer takes the longitudinal portions 27A in his grasp so as to elastically deform the longitudinal portions 27A inwardly. The drummer inserts the longitudinal portions 27A into the gap between the side walls 25B until the lugs 27C reach the lateral holes 24*c*. The drummer aligns the lugs 27C with the lateral holes 24*c*, and release the longitudinal portions 27A. The longitudinal portions 27A elastically expand, and the lugs 27C are inserted into the lateral holes 24*c*, respectively. Thus, the connector 23*b* is assembled with the supporting block 24 without the use of any tool. Moreover, only the connector 23*b* is used for the interconnection between the base plate 24 and the heel 23*a*, and the supporting structure 22 is simpler than that of the prior art high-hat stands.

When a drummer sets the high-hat stand according to the present invention upright on the floor FL, only the bottom surfaces of the side walls 25B are held in contact with the floor FL, and the upper flat plate 25A is spaced from the floor. Even if the high-hat stand is set upright on a rough surface, the drummer places the wide walls 25B on opposite sides of a rise, and makes the rough surface less influential. Morever, the geometric moment of inertia of the extensive block 25 is so large that bending moment can not deform the base plate.

The pedal mechanism 23 includes the heel 23*a*, the connector 23*b*, a foot pedal 23*c* and a flexible connector 23*d*. The foot pedal 23*c* is hinged to the heel 23*a* at one end thereof, and the flexible connector 23*d* is connected between the lower end of the extension rod 21 and the other end of the foot pedal 23*c*. The flexible connector 23*d* is formed of leather. When a drummer steps on the foot pedal 23*c*, the foot pedal is driven for rotation in the counter clockwise direction as viewed in FIG. 3, and the flexible connector 23*d* converts the rotation to a straight motion of the extension rod 21. The extension rod 21 is downwardly moved against the elastic force of the return spring 10, and the movable cymbal 1B is clashed against the stationary cymbal 1A. When the drummer releases the foot pedal 23*c*, the return spring 10 pushes up the extension rod 21, and the movable cymbal 1B is spaced from the stationary cymbal 1A. Thus, the pedal mechanism 23 is similar to that of the prior art high-hat stand.

Although the extension block 25 per se prevents the telescopic guide 20 from a violent fall, the connector 23*b* cooperates with the heel 23*a* so as to further prevent the telescopic guide 20 from the violent fall. Assuming now that a drummer sets the high-hat stand upright on the floor FL, and attaches the high-hat cymbals 1 separately to the telescopic guide 20 and the extension rod 21. The total weight of the telescopic guide 20, the extension rod 21 and the high-hat cymbals 1 are assumed to be exerted on the center of gravity, and the center of gravity is found on a center line of the extension rod 21 or the extension line thereof. As described hereinbefore, the extension block 25 projects frontwardly from the supporting block 24, and is integral therewith. The front end of the extension block 25 is farther from the posts 22*h* than the base plate 11A of the prior art high-hat stand. In this instance, the distance L (FIG. 4) between the front end and the posts 22*h* is 70 to 100 millimeters. The distance L1 between the front end of the supporting block 24 and the front end of the extension block 25 is of the order of 50 millimeters, and the distance L2 between the lateral holes 24*c* and the front end of the supporting block 24 is of the order of 16 millimeters. The base plate 11A of the prior art high-hat stand is equivalent to the supporting block 24, and the distance from the posts 22*h* and the front end of the base plate 11A is prolonged by L1, i.e., about 50 millimeters long.

While a drummer is playing a tune on the drum set, the movable cymbal 1B is clashed against the stationary cymbal 1A as described hercinbefore, and the drummer strikes the high-hat cymbal 1B with a stick. A moment is exerted on the high-hat stand, and the high-hat stand becomes unstablc. The center of gravity is liable to be offset from the center line of the extension rod 21 and the extension line thereof. If the high-hat stand is placed on a rough surface or a sloop, the center of gravity is also offset from the center line and the extension line. If the center of gravity is moved frontwardly over the front end of the base plate 11A, a moment is exerted around the front end due to the total weight of the telescopic guide 20, the extension rod 21 and the high-hat cymbals 1, and makes the high-hat stand unstable. In order for the high-hat stand to withstand this moment, the distance L is longer than the offset in the center of gravity. The present inventor investigated the motion of the high-hat stand used for standard high-hat cymbals, and experimentally determined the maximum value of the offset of the center of gravity. Although the distance between the posts and the front end is less than the maximum offset in the prior art high-hat stand, the distance L of the present invention is greater than the maximum offset, and the extension block 25 enhances the stability of the high-hat stand.

Even if the center of gravity is moved over the front end of the extension block 25, the heel 23*a* generates the counter moment, and keeps the high-hat stand upright. However, if the connector 23*b* is deformed, the high-hat stand becomes unstable. In order to prevent the connector from the plastic deformation, it is necessary to increase the modulus of section. In this instance, the round bar 28 is larger in diameter than the connector 14 of the prior art high-hat stand. As described hcreinbcfore, the round bar used for the connector 14 is 6 millimeter in diameter, and the geometrical moment of inertia, i.e., $I=\pi d^4/64$ where d is the diameter, is 63.58. On the other hand, the round bar 28 is 8 millimeters in diameter, and the geometrical moment of inertia is 200.96. Thus, the connector 23*b* is more than three times larger in geometrical moment of inertia than that of the prior art high-hat stand. Accordingly, the connector 23*b* is larger in modulus of section than the connector 14. For this reason, the connector 23*b* keeps the longitudinal portions 27A straight against the maximum bending moment larger than that exerted on the connector 14. However, when the connector 23*b* is assembled with the supporting block 24, the modulus of section permits the player to elastically deformed.

In general, the flexural strength of the connector 23*b* is to be large enough to keep the longitudinal portions 27A straight against the bendin(g moment exerted thereon during the performance. Although the maximum bending moment exerted during perflormances was not constant among drummers, the present inventor experimentally determined the bending moment exerted during the performances and the flexural strcngth of the connector 23*b* to be required. Although the modulus of section of the round bar used for the prior art connector 14 makes the maximum bending stress larger than the critical value, the round bar 28 has the flexural strength much larger than the maximum bcnding stress due to the bending moment experimentally determined. Thus, the connector 23*b* prevents the high-hat stand and the high-hat cymbals from a violent fall, and is conducive to the stability of the high-hat stand according to the present invention.

The present inventor confirmed that the satisfaction of the following equation 1 surely prevented the high-hat stand from a violent fall during performances.

$$X1/X2 \geqq 0.3$$

where X1 is the distance between the center lines of the posts 22*h* and the front end of the extension block 25 and X2 is the distance between the center lines of the posts 22*h* and the front end of the heel 13.

As will be understood from the foregoing description, the connector 23*b* is formed from a single bar, and the hccl 23*a* is connected to the pedestal 22*c* by means of the simple connector 23*b*. This results in a simple structure and good appearance. Moreover, the production cost is reduced.

The connector 23*b* is elastically engaged with the base plate 22*f*, and a drummer can assemble the pedal mechanism 23 with the pedestal 22*e* without any tool. This makes the connector easy to use.

The extension block 25 projects frontwardly from the supporting block 24, and prevents the high-hat cymbals 1 attached to the telescopic guide/ extension rod 20/21 from a violent fall toward the drummer. Finally, the connector 23*b* has a bending strength which is larger than the maximum bending moment exerted thereon during usual performance, and permits the heel 23*a* to prevent the high-hat cymbals 1 attached to the telescopic guide/ extension 20/21 from a violent fall.

Thus, the high-hat stand implementing the first embodiment is simple and easy to use without sacrifice of the stability.

Second Embodiment

Figure 8:
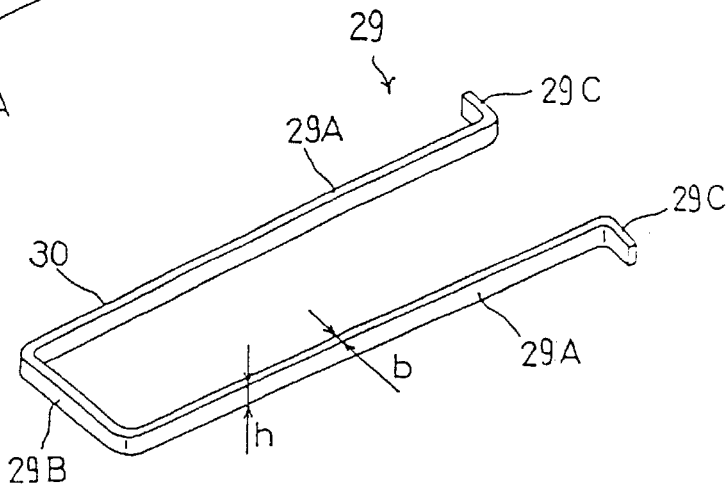
FIG. 8 is a perspective view showing another connector incorporated in another high-hat stand according to the present invention.

Turning to FIG. 8 of the drawings, a connector 29 incorporated in another high-hat stand embodying the present invention is formed from a rectangular bar 30 of metal or alloy. The high-hat stand implementing the second embodiment is similar in structure to the first embodiment except the connector 29. For this reason, description is focused on the connector 29, and no further description is incorporated hereinbelow for the sake of simplicity.

The rectangular bar 30 is four times bent, and the connector 29 has a generally U-letter shape. Longitudinal portions 29A are rearward project from both ends of a lateral portion 29B, and lugs 29C arc sideward project from the longitudinal portions 29A. The lugs 29C are inserted into the lateral holes 24*c* of the supporting block 24, and the heel 23*a* is connected to the supporting block 24 by means of the connector 29. Thus, the connector 29 serves as similar to the connector 23*b* of the first embodiment.

The connector 29 is different in cross section from the connector 23*b*. The connector 29 has a rectangular cross section. The width is 4 millimeters, and the height is 6 millimeters. Thc geometric moment of inertia, i.e., $I=bh^3/12$ where b is width and h is height, is the diameter, is 72. Thus, the connector 29 is larger in geomctric moment of incrtia than the connector 14 of the prior art high-hat cymbal. Accordingly, the connector 29 is larger in modulus of section than the connector 14. For this reason, the connector 23*b* keeps the longitudinal portions 29A straight against the maximum bending moment cxperimentally determined.

The high-hat stand implcmenting the second embodiment achieves all the advantages of the first embodiment.

In the abovc-described embodiments, the extension block 25, the connector 23*b*/29 and the hccl as a whole constitute a safety device against overturning. The telescopic guide 20 and the extension rod 21 form in combination a driving mechanism.

Although particular embodiments of the present invention have been shown and described, it will be apparent to those skilled in the art that various changes and modifications may be made without departing from the spirit and scope of the present invention.

For example, the present invention is applicable to another stand for a musical instrument equipped with a pedal mechanism. A high-hat stand may be equipped with the spring unit attached to the outer surface of the telescopic guide.

Yet another embodiment may have the connector directly connected to the supporting block. In this instance, the safety device against the overturningy is implemented by the combination of the connector and the heel.

The lateral holes may be replaced with gaps formed between pairs of projections so that the lugs are snugly received in the gaps.

The round bar and the rectangular bar may have the values of the gieometric moment of inertia larger than those of the above-described embodiments.

What is claimed is:

1. A stand for a musical instrument comprising:

(A) a driving mechanism adapted to be connected to said musical instrument and actuated for generating sound;

(B) a pedal mechanism having a pedal plate connected to said driving mechanism, said pedal plate being manipulatable by a player for actuating said driving mechanism, and a heel placed on a surface, said heel providing an axis of rotation to said pedal plate; and (C) a supporting structure connected to said driving mechanism and said pedal mechanism for stabilizing said driving mechanism on said surface, said supporting structure including:

(1) a pedestal placed on said surface and receiving the weight of said driving mechanism and said musical instrument and (2) a safety device for inhibiting the overturning of said stand, said safety device connected between said pedestal and said heel and including a connector fonned from a single bar and having a modulus of section so as to keep the elasticity thereof against a maximum bending moment exerted on said stand during a performance, one end of said connector being elastically connected to said pedestal.

2. The stand for a musical instrument as set forth in claim 1, in which said connector has a generally U-letter shape, and is elastically connected to said pedestal at bifurcated end portions thereof.

3. The stand for a musical instrument as set forth in claim 2, in which said bifurcated end portions are formed with lugs which project sidewardly, and said pedestal is formed with holes where said lugs are snugly received.

4. The stand for a musical instrument as set forth in claim 2, in which the generally U-letter shaped bar has a circular cross section.

5. The stand for a musical instrument as set forth in claim 4, in which said circular cross section has a diameter greater than 6 millimeters.

6. The stand for a musical instrument as set forth in claim 5, in which said diameter is equal to or greater than 8 millimeters.

7. The stand for a musical instrument as set forth in claim 2, in which the generally U-letter shaped bar has a rectangular cross section.

8. The stand for a musical instrument as set forth in claim 7, in which said rectangular cross section has a geometric moment of inertia larger than 63.58.

9. The stand for a musical instrument as set forth in claim 8, in which said geometric moment of inertia is equal to or greater than 72.

10. The stand for a musical instrument as set forth in claim 1, in which said stand has a normal center of gravity and a maximum offset center of gravity when said maximum bending moment is exerted on said stand and wherein said safety device further includes an extension block projecting from said pedestal toward said heel and having a leading end spaced from said center of gravity by a distance which is greater than the distance between said normal center of gravity and said maximum offset center of gravity as measured in a direction perpendicular to the direction of gravity.

11. The stand for a musical instrument as set forth in claim 10, in which said extension block is integral with a base plate forming said pede stal together with a vertical portion upwardly projecting from said base plate.

12. The stand for a musical instrument as set forth in claim 10, in which said extension block has an upper flat plate and side walls downwardly projcecting from opposite side portions of said upper flat plate and held in contact with said surface so that said side walls space said upper flat plate from said surface.

13. The stand for a musical instrument as set forth in claim 1, in which said driving mechanism includes a guidc tube and a rod movably inserted in said guide tube and connected to said pedal mechanism.

14. The stand for a musical instrument as set forth in claim 13, in which said guide tube and said rod are respectively connected to a stationary cymbal and a movable cymbal which is clashed against said stationary cymbal when said pedal mechanism gives rise to relative motion between said guide tube and said rod.

15. The stand for a musical instrument as set forth in claim 1, in which supporting structure further has a plurality of legs connected at upper cnds thereof to said driving mechanism and held in contact with said surface at lower end thereof for setting said driving mechanism upright on said surface.

16. The stand for a musical instrument as set forth in claim 15, in which said plurality of legs are two legs, and contact spots between said lower ends and said surface are located in an area extending in an opposite direction to an area where said heel is placed with respect to said pedestal.

* * * * *